US012722870B2

(12) United States Patent
Farra

(10) Patent No.: US 12,722,870 B2
(45) Date of Patent: Sep. 1, 2026

(54) THERMAL DAMPENING DEVICE FOR A BEVERAGE CONTAINER

(71) Applicant: Gerard M. Farra, Fountainville, PA (US)

(72) Inventor: Gerard M. Farra, Fountainville, PA (US)

( * ) Notice: Subject to any disclaimer, the term of this patent is extended or adjusted under 35 U.S.C. 154(b) by 0 days.

(21) Appl. No.: 18/436,152

(22) Filed: Feb. 8, 2024

(65) Prior Publication Data

US 2025/0256906 A1 Aug. 14, 2025

(51) Int. Cl.
*B65D 81/38* (2006.01)

(52) U.S. Cl.
CPC ..... *B65D 81/3834* (2013.01)

(58) Field of Classification Search
CPC ..... B65D 81/3834; B65D 81/3823; B65D 81/3813
USPC ..... 220/592.2; 126/201, 283
See application file for complete search history.

(56) References Cited

U.S. PATENT DOCUMENTS

2021/0101840 A1* 4/2021 Kimura ..... C23C 24/04
2021/0198920 A1* 7/2021 Crandall ..... E04H 17/1413

* cited by examiner

*Primary Examiner* — Anthony D Stashick
*Assistant Examiner* — Lauren Kmet
(74) *Attorney, Agent, or Firm* — IP Works Law PLLC

(57) ABSTRACT

A thermal dampening device for a beverage container is shown and described. The thermal dampening device includes a base. The base has a first sidewall and a second sidewall rising therefrom. The first sidewall and the second sidewall are made up of at least two layers of material. At least one of the two layers is a thermal dampening layer.

1 Claim, 5 Drawing Sheets

THERMAL DAMPENING DEVICE FOR A BEVERAGE CONTAINER

BACKGROUND OF THE INVENTION

The present invention relates to thermal dampening devices. More particularly, the present invention provides a device to hold a beverage which will keep the beverage and the container it is in from becoming hot when exposed to a heat source.

Many people enjoy beverages when sitting near a heat source such as a fire or propane generated source. These heat sources are capable of putting off a tremendous amount of heat. This heat can then transfer to a beverage container, and in some instances the beverage inside. Some heat sources are designed to have an edge for setting beverages on. This, which convenient, places the beverage even closer to the heat source.

In some cases, this may be helpful in keeping something like a coffee warm for extended periods of time. However, when the beverage is supposed to be kept cold, like a beer or soda, the life of the beverage can be cut extremely short due to the quick rise in temperature. This temperature rise often results in a lack of enjoyment.

Due to the nature of some heat sources beverage containers are also capable of being heated to an unsafe level. For example, sometimes fires can heat glass or metal containers to a level which may burn a user. This means even if a product is used that will keep the beverage itself cool the container may become a problem.

Consequently, there is a need for an improvement in the art of thermal protection for beverages. The present invention substantially diverges in design elements from the known art while at the same time solving a problem many people face when sitting near a heat source with a beverage. In this regard the present invention substantially fulfills these needs.

SUMMARY OF THE INVENTION

The present invention provides a thermal dampening device for a beverage container wherein the same can be utilized for providing convenience for the user when enjoying a beverage near a heat source. The thermal dampening device includes a base having a first sidewall and a second sidewall rising therefrom. The sidewalls share an edge. The first sidewall and the second sidewall are made from at least two layers of material. One of the layers is made from a thermal dampening material.

Another object of the device is to have the first layer of material be a solid material.

The Another object of the device is to have the first layer of material be aluminum.

Another object of the device is to have a second layer of material be a coating.

Another object of the device is to have the second layer of material be a thermal dampening paint.

Another object of the device is to have a cover secured to the first sidewall and the second sidewall opposite the base.

Other objects, features and advantages of the present invention will become apparent from the following detailed description taken in conjunction with the accompanying drawings.

BRIEF DESCRIPTION OF THE DRAWINGS

Although the characteristic features of this invention will be particularly pointed out in the claims, the invention itself and manner in which it may be made and used may be better understood after a review of the following description, taken in connection with the accompanying drawings wherein like numeral annotations are provided throughout.

LIST OF REFERENCE NUMERALS

Figure 1:
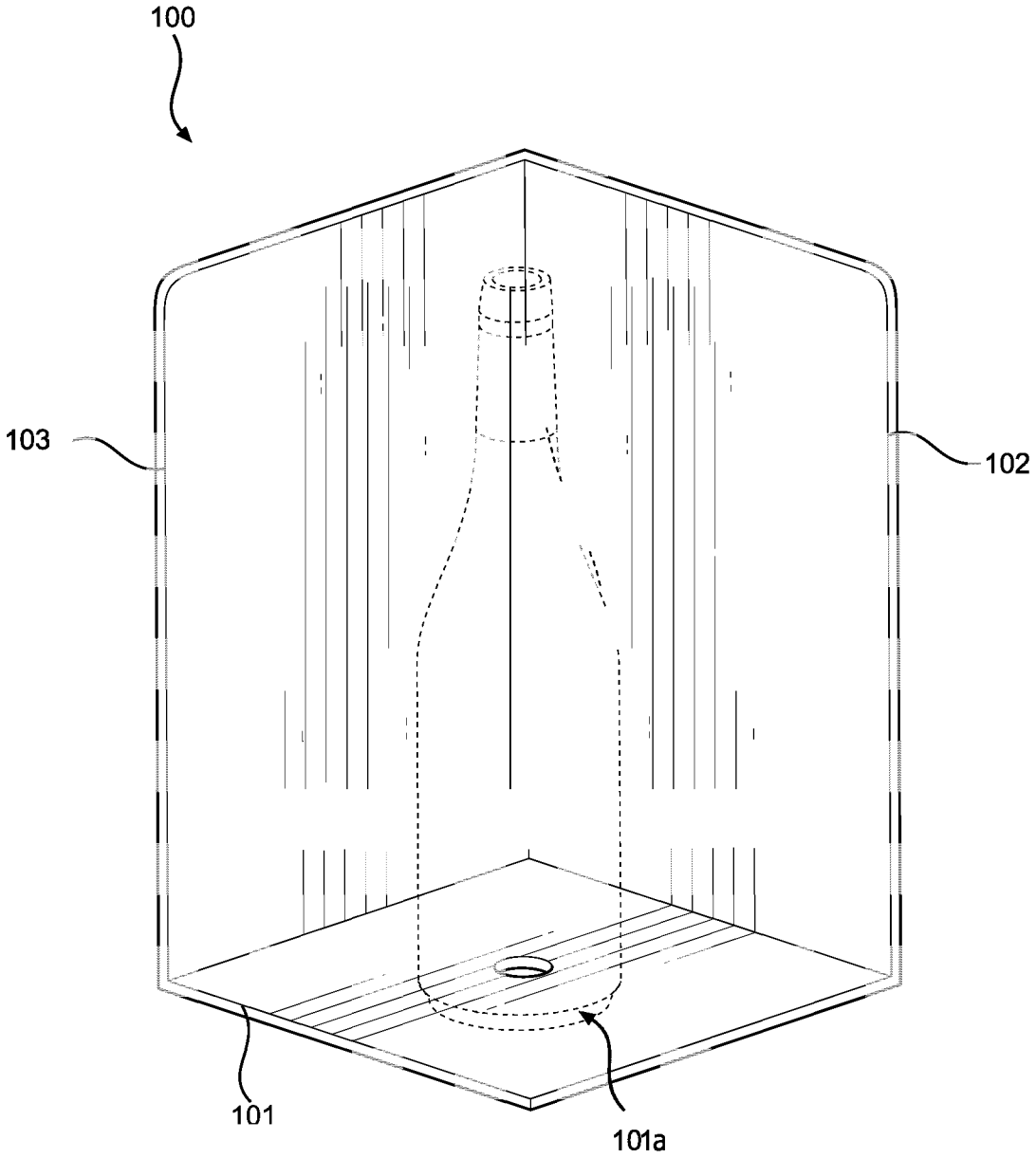
FIG. 1 shows a perspective view of one embodiment of the thermal dampening device for a beverage container.

With regard to the reference numerals used, the following numbering is used throughout the drawings.

| | |
|---|---|
| 100 | Thermal Dampening Device |
| 101 | Base |
| 101a | Aperture |
| 102 | First Sidewall |
| 102a | Exterior of First Sidewall |
| 103 | Second Sidewall |
| 103a | Exterior of Second Sidewall |
| 201 | First Layer |
| 202 | Second Layer |
| 301 | Cover |
| 302 | Handle |
| 401 | Base |
| 402 | Sidewall |
| 501 | Heat Source |
| 502 | Beverage Container |

DETAILED DESCRIPTION OF THE INVENTION

Reference is made herein to the attached drawings. Like reference numerals are used throughout the drawings to depict like or similar elements of the thermal dampening device for a beverage container. For the purposes of presenting a brief and clear description of the present invention, a preferred embodiment will be discussed as used for the thermal dampening device for a beverage container. The figures are intended for representative purposes only and should not be considered to be limiting in any respect.

Referring now to FIG. 1, there is shown a perspective view of one embodiment of the thermal dampening device for a beverage container. The thermal dampening device 100 includes a base 101. The base has at least one sidewall rising therefrom. In the shown embodiment a first sidewall 102 rises therefrom adjacent to a second sidewall 103 rising therefrom such that the first sidewall 102 and the second sidewall 103 share an edge. In one embodiment the opposite corners of the first sidewall 102 and the second sidewall 103 are rounded to remove sharp edges.

The base 101 must have a surface area which is sufficient enough to prevent the thermal dampening device 100 from tipping due to the weight of the first sidewall 102 and the second sidewall 103 creating a higher center of gravity. In different embodiments the base 101 may be of different geometric shapes. In one embodiment the base 101 is rectangular. In another embodiment as described below the base 101 is round. In one embodiment the base 101 has an aperture 101*a* therein. The aperture 101*a* can be used as a drain to allow sweat from a beverage container to drain from the base 101. In another embodiment the aperture 101*a* can be used as a securement hole. In this embodiment a fastener can be placed therein to secure the thermal dampening device 100 to a surface.

The thermal dampening device 100 shall be of a size which will allow for a beverage container to be placed on the base 101. When placed the beverage should still be able to be grasped and removed without knocking over the thermal dampening device 100.

Figure 2:
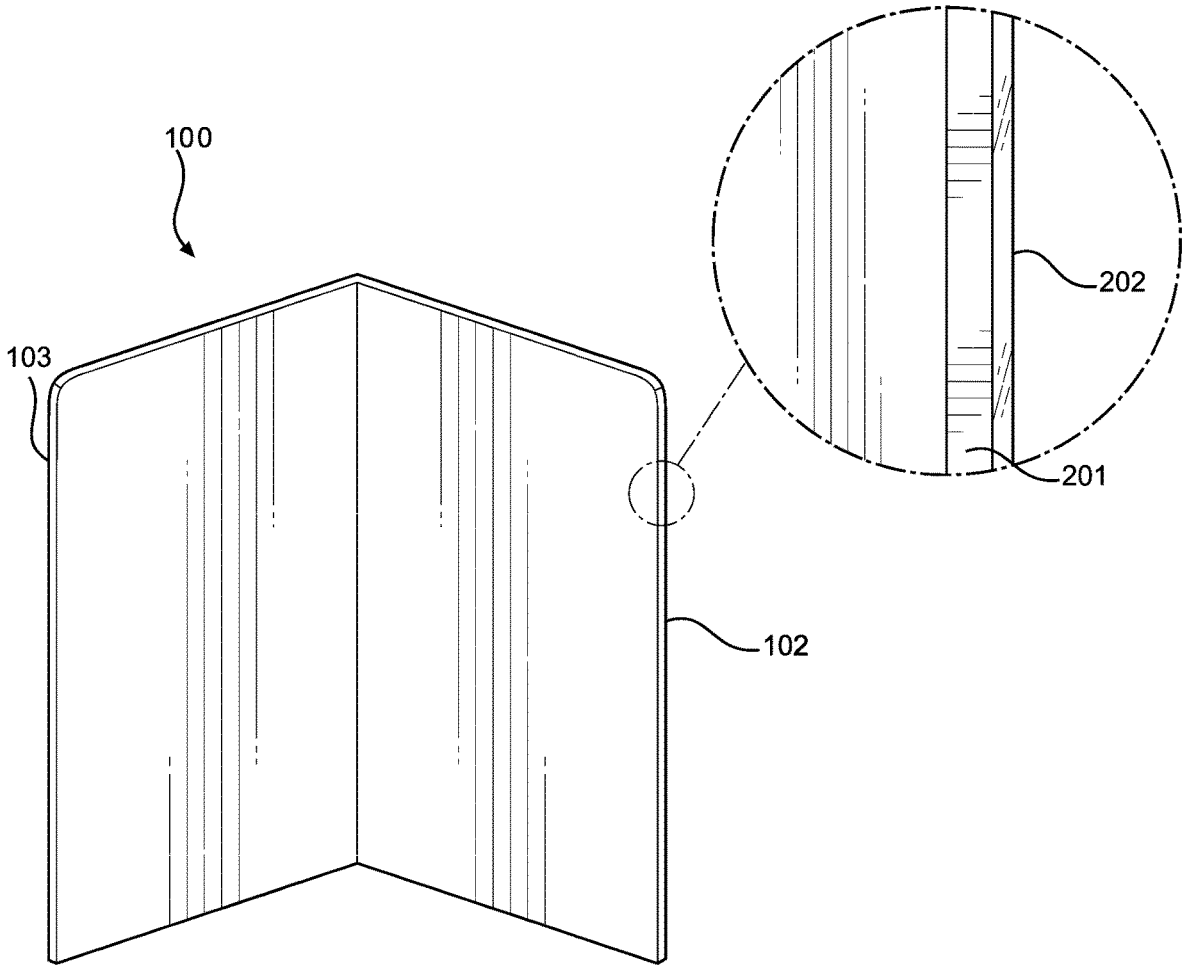
FIG. 2 shows a perspective view of one embodiment of the thermal dampening device for a beverage container.

Referring now to FIG. 2, there is shown a perspective view of one embodiment of the thermal dampening device for a beverage container. In one embodiment the thermal dampening device 100 only includes the first sidewall 102 and the second sidewall 103. The base has been removed. This will allow for the thermal dampening device 100 to require less material. In one embodiment this will allow for the thermal dampening device 100 to be easily stackable for storage.

The thermal dampening device 100 is made of at least two layers of material. A first layer of material 201 is made from a solid material. In one embodiment aluminum is used because it has a temperature dampening property. In another embodiment other materials may be used such as steel or iron. In some embodiments heat resistant plastic could be used to the same effect.

The thermal dampening device 100 includes a second layer of material 202. In some embodiments the second layer of material 202 is a solid layer. In other embodiments the second layer of material 202 is a coating of the first layer of material 201. In some embodiments the coating is paint. In other embodiments the coating is enamel. In one embodiment the second layer of material is a coating including temperature resistant and dampening paint. In another embodiment the coating is a ceramic coating.

In some embodiments additional layers or partial layers may be included. For example, in one embodiment a deco may be added to the front of the thermal dampening device 100. In another embodiment an additional heat dampening layer may be included. In yet a further embodiment a layer may be added to the inside of the first layer 201.

Figure 3:
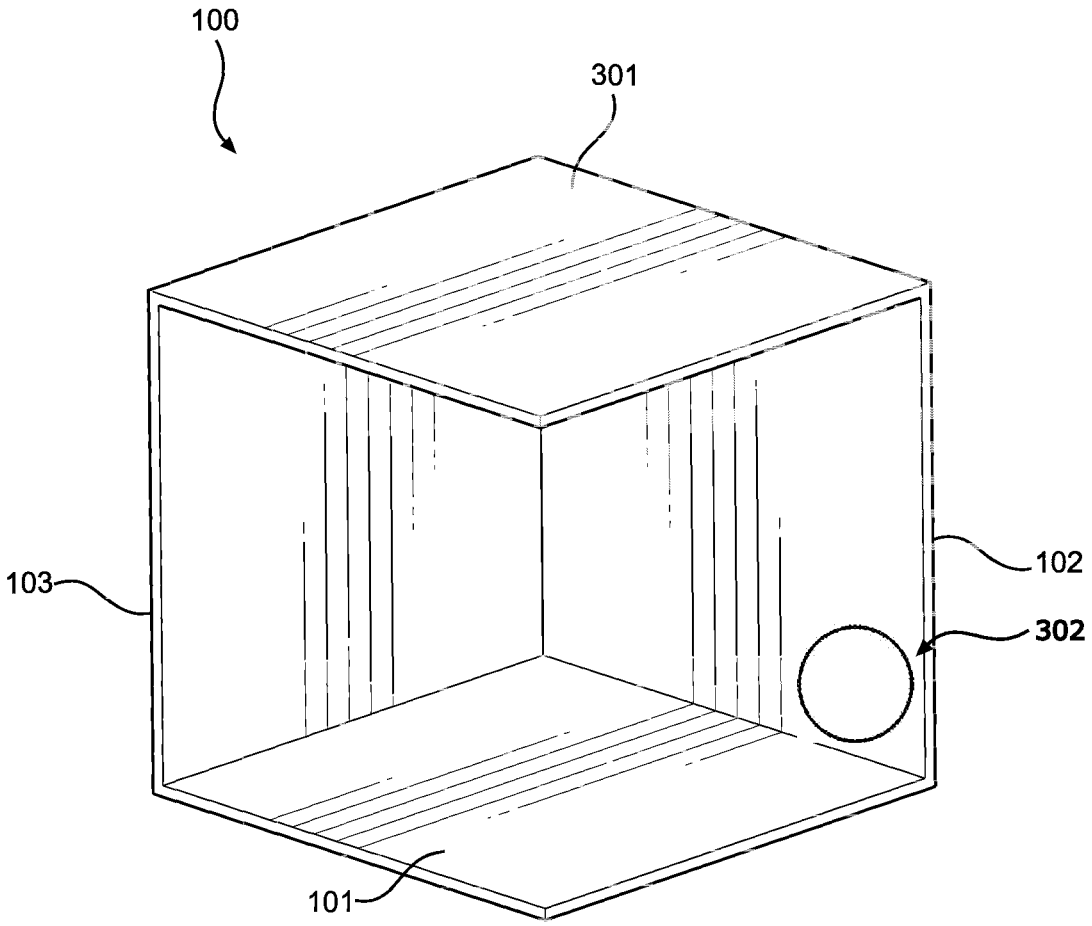
FIG. 3 shows a perspective view of one embodiment of the thermal dampening device for a beverage container.

Referring now to FIG. 3, there is shown a perspective view of one embodiment of the thermal dampening device for a beverage container. In yet another embodiment of the thermal dampening device 100 a cover 301 may be included. The cover 301 is configured to attached to at least one sidewall at an end opposite the base 101. In this embodiment the cover 301 is attached to the first sidewall 102 and the second sidewall 103. The cover 301 can have several purposes. In one instance the cover 301 can prevent the debris from entering a beverage. In another instance, the cover 301 can further help to prevent heat transfer.

The cover 301 is designed to be made of the same materials and layers as the rest of the thermal dampening device 100. In this embodiment the cover 301 will have a first layer and a second layer. The second layer will be a thermal dampening layer.

In one embodiment the thermal dampening device 100 includes a handle 302 of sorts. In the shown embodiment the thermal dampening device 100 includes the cover 301. However, the handle 302 is independent of the cover. In one embodiment the handle 302 is an aperture located through one of the sidewalls. The handle 302 will allow for a user to use a single finger placed therein to move the device.

Figure 4:
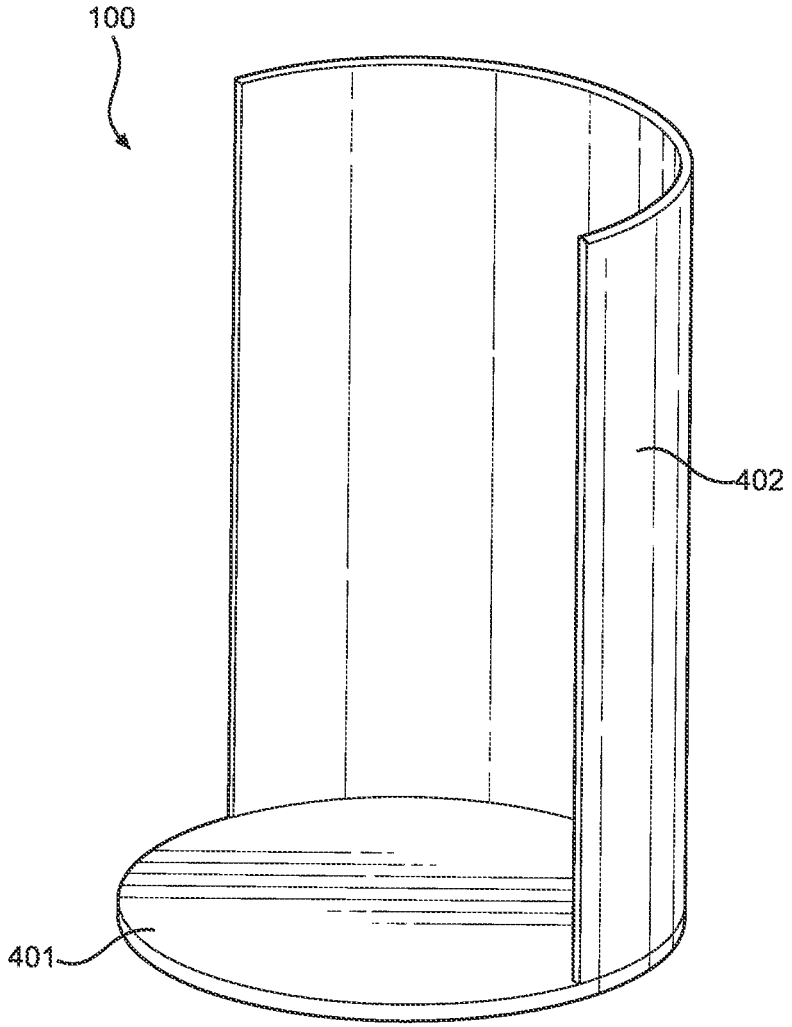
FIG. 4 shows a perspective view of one embodiment of the thermal dampening device for a beverage container having a round sidewall.

Referring now to FIG. 4, there is shown a perspective view of one embodiment of the thermal dampening device for a beverage container having a round sidewall. In another embodiment the thermal dampening device 100 includes a base 401. In the shown embodiment the base 401 is a round base. A single sidewall 402 rises therefrom. The round base 401 allows for a single curved sidewall 402 to cover a similar amount of surface areas as multiple flat sidewalls connected at angles.

Figure 5:
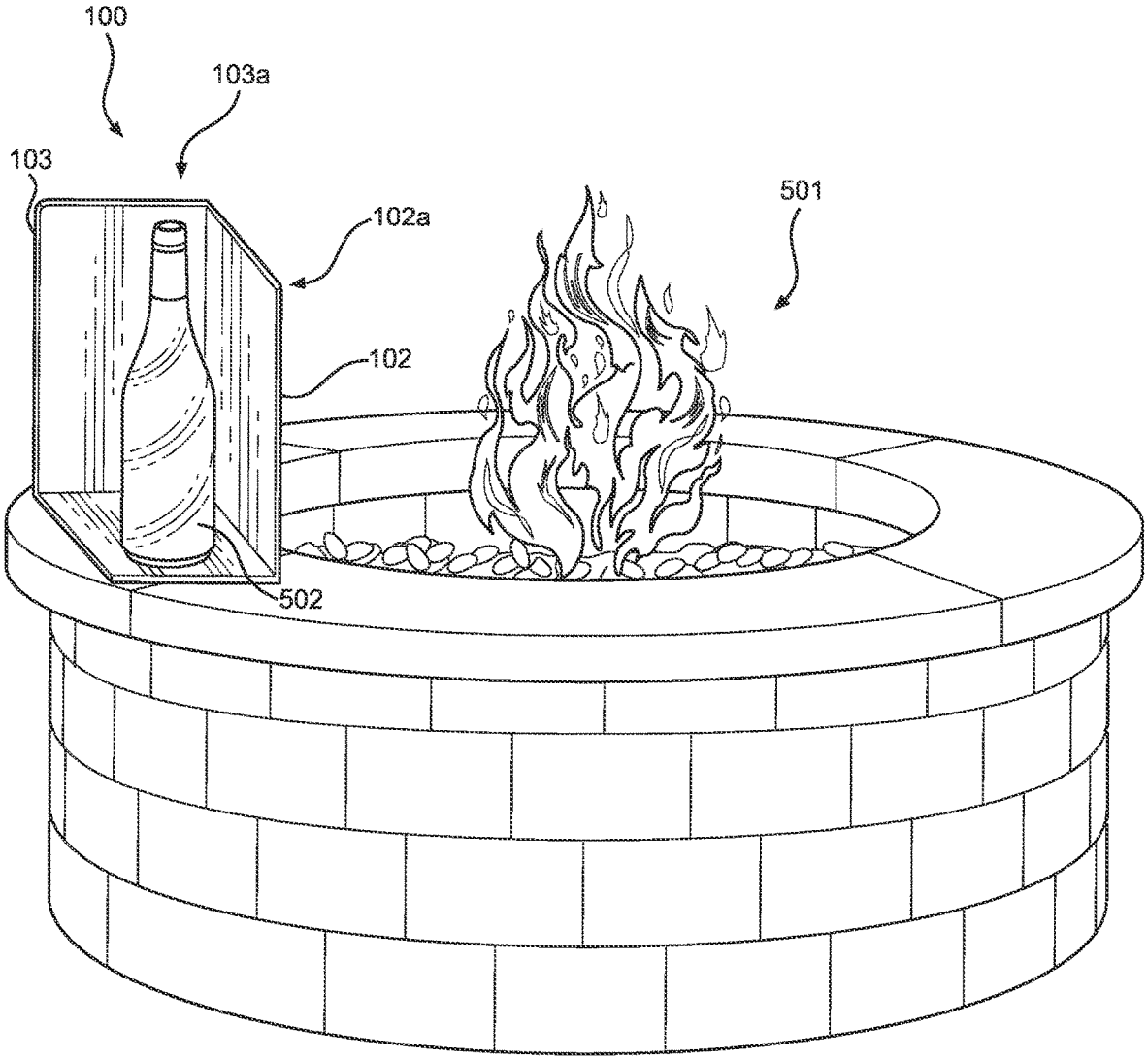
FIG. 5 shows a perspective in-use view of one embodiment of the thermal dampening device for a beverage container.

Referring now to FIG. 5, there is shown a perspective in-use view of one embodiment of the thermal dampening device for a beverage container. In use thermal dampening device 100 can be placed near a heat source 501 such that an exterior 102*a* of the first sidewall 102 and an exterior 103*a* of the second sidewall 103 are facing the heat source 501. In different embodiments a heat source 501 may be different items. In one embodiment a heat source 501 is a fire. In another embodiment the heat source is a propane heat generation device.

The first sidewall 102 and the second sidewall 103 will prevent heat from the heat source 501 from penetrating through to a beverage container 502 which is placed on the base 101 of the thermal dampening device 100. In this way the beverage container 502 will be kept cool. This will help the container maintain a temperature which can be grasped. In a further embodiment this will allow for the beverage inside of the beverage container 502 to stay cool as well.

It is therefore submitted that the instant invention has been shown and described in what is considered to be the most practical and preferred embodiments. It is recognized, however, that departures may be made within the scope of the invention and that obvious modifications will occur to a person skilled in the art. With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

The invention claimed is:

1. A thermal dampening device, consisting of:

a base plate having a rectangular shape and being rectangular in cross-section, the base plate having a first base edge and a second base edge, the first base edge and the second base edge being adjacent to each other;

a first sidewall formed as a solid plate extending from the first base edge of the base plate, the first sidewall having a first end at the base plate and a second end opposite the base plate, the first sidewall further comprising a pair of vertical edges extending between the first end and the second end;

a second sidewall formed as a solid plate extending from the second base edge of the base plate, the second sidewall having a first end at the base plate and a second end opposite the base plate, the second sidewall further comprising a pair of vertical edges extending between the first end and the second end;

a single handle opening extending entirely through a thickness of the second sidewall proximate to the base plate; and a top plate having a rectangular shape and being rectangular in cross-section, the top plate further having a first top edge and a second top edge, the first top edge and the second top edge being adjacent to each other;

wherein:

the second end of the first sidewall is connected to the first top edge of the top plate, and the second end of the second sidewall is connected to the second top edge of the top plate, the base plate, the first sidewall, the second sidewall, and the top plate are integral and monolithic, the handle opening is circular and is configured to facilitate a user grasping the thermal dampening device therethrough, the first sidewall is orthogonal to the base plate, the second sidewall, and the top plate, and the second sidewall is orthogonal to the base plate, the first sidewall, and the top plate, the base plate and the top plate are parallel to each other and are equally sized and shaped, one vertical edge of the pair of vertical edges of the first sidewall is connected to one vertical edge of the pair of vertical edges of the second sidewall, the first sidewall and the second sidewall are made from two layers of material, a first layer of material of the two layers of material is aluminum, and a second layer of material of the two layers of material is a ceramic coating.

* * * * *